US011953219B2

(12) United States Patent
Inoue et al.

(10) Patent No.: US 11,953,219 B2
(45) Date of Patent: Apr. 9, 2024

(54) TAKEOVER SYSTEM FOR AN AIR CONDITIONING APPARATUS TO TRANSMIT INFORMATION FROM A FIRST BOARD TO A SECOND BOARD

(71) Applicant: DAIKIN INDUSTRIES, LTD., Osaka (JP)

(72) Inventors: Yukio Inoue, Osaka (JP); Hideaki Tanaka, Osaka (JP); Naoki Bito, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/206,706

(22) Filed: Jun. 7, 2023

(65) Prior Publication Data

US 2023/0314028 A1 Oct. 5, 2023

Related U.S. Application Data

(63) Continuation of application No. PCT/JP2021/044528, filed on Dec. 3, 2021.

(30) Foreign Application Priority Data

Dec. 24, 2020 (JP) ..... 2020-214611

(51) Int. Cl.
*F24F 11/49* (2018.01)
*F24F 11/46* (2018.01)

(52) U.S. Cl.
CPC ..... *F24F 11/49* (2018.01); *F24F 11/46* (2018.01)

(58) Field of Classification Search
CPC .. F24F 11/49; F24F 11/46; F24F 11/30; F24F 11/52; F24F 11/89; F24F 11/32; F24F 11/88
See application file for complete search history.

(56) References Cited

U.S. PATENT DOCUMENTS 4,454,596 A * 6/1984 Wunsch ..... G05B 19/0423 439/43
5,435,147 A * 7/1995 Mochizuki ..... H04L 67/125 236/51

(Continued)

FOREIGN PATENT DOCUMENTS

JP 10-300177 A 11/1998
JP 2007-318572 A 12/2007

(Continued)

OTHER PUBLICATIONS

International Search Report (PCT/ISA/210) issued in PCT/JP2021/044528 dated Jan. 11, 2022.

(Continued)

*Primary Examiner* — Ramesh B Patel
(74) *Attorney, Agent, or Firm* — BIRCH, STEWART, KOLASCH & BIRCH, LLP

(57) ABSTRACT

An information takeover system includes: a first board that includes a first control unit and a first storage unit storing first information about an air conditioning apparatus; and a second board that includes a second control unit and is connectable to the first board in an information exchangeable manner. The first control unit is configured to perform first control to transmit the first information to the second board with the first board and the second board connected to each other in the information exchangeable manner.

14 Claims, 8 Drawing Sheets

(56) References Cited

U.S. PATENT DOCUMENTS 6,102,665 A * 8/2000 Centers ..... F04B 49/10 417/18
6,471,486 B1 * 10/2002 Centers ..... F04B 49/10 417/18
6,489,742 B2 * 12/2002 Lumsden ..... H02P 27/02 318/729
7,848,852 B2 * 12/2010 Sakae ..... F24F 11/46 324/543
9,958,179 B2 * 5/2018 Sugiyama ..... F24F 11/30
2001/0056544 A1 * 12/2001 Walker ..... B60W 50/029 180/170
2006/0116790 A1 * 6/2006 Chung ..... F24F 11/49 236/51
2008/0223944 A1 * 9/2008 Helt ..... F24F 11/64 236/51
2011/0012661 A1 * 1/2011 Binder ..... A63H 33/08 307/41
2013/0297077 A1 * 11/2013 Kaneko ..... G05D 23/19 700/276
2016/0030658 A1 * 2/2016 van der Merwe ..... A61M 1/362265 604/67
2016/0299766 A1 * 10/2016 Shitaya ..... G06F 9/445
2019/0257541 A1 * 8/2019 Ono ..... G05B 19/0428
2019/0385057 A1 * 12/2019 Litichever ..... H04L 63/14
2020/0326320 A1 * 10/2020 Querrey ..... G01N 1/24
2022/0102583 A1 * 3/2022 Baumheinrich ..... H01L 27/156
2022/0294411 A1 * 9/2022 Sato ..... H03H 7/46
2023/0003851 A1 * 1/2023 Tanaka ..... G01S 7/497

FOREIGN PATENT DOCUMENTS

JP 2009-19780 A 1/2009
JP 2010-152641 A 7/2010
JP 2013-234763 A 11/2013
JP 2013-238340 A 11/2013
JP 2014-16062 A 1/2014
JP 2020-46165 A 3/2020
WO WO 2019/244389 A1 12/2019

OTHER PUBLICATIONS

English translation of International Preliminary Report on Patentability and Written Opinion of the International Searching Authority for International Application No. PCT/JP2021/044528, dated Jun. 13, 2023.

* cited by examiner

TAKEOVER SYSTEM FOR AN AIR CONDITIONING APPARATUS TO TRANSMIT INFORMATION FROM A FIRST BOARD TO A SECOND BOARD

CROSS REFERENCE TO RELATED APPLICATIONS

This application is a Continuation of PCT International Application No. PCT/JP2021/044528, filed on Dec. 3, 2021, which claims priority under 35 U.S.C. 119(a) to Patent Application No. 2020-214611, filed in Japan on Dec. 24, 2020, all of which are hereby expressly incorporated by reference into the present application.

TECHNICAL FIELD

The present disclosure relates to an information takeover system, a second board, an air conditioning apparatus, and an information takeover method.

BACKGROUND ART

In an air conditioning apparatus disclosed in, for example, Patent Literature 1, if a control board becomes defective in a remote controller for operating an air conditioning unit, this defective control board is replaced with a new control board. At this replacement work, information stored in a memory of the defective control board is backed up to a memory of the air conditioning unit. The information backed up to the memory of the air conditioning unit is transferred to a memory of the new control board.

CITATION LIST

Patent Literature

PATENT LITERATURE 1: Japanese Laid-Open Patent Publication No. 2007-318572

SUMMARY

An information takeover system according to the present disclosure includes:

a first board that includes a first control unit, and a first storage unit storing first information about an air conditioning apparatus; and a second board that includes a second control unit and is connectable to the first board in an information exchangeable manner; and a cable configured to connect the first board and the second board to each other in the information exchangeable manner, wherein the first control unit is configured to perform first control to transmit the first information to the second board with the first board and the second board connected to each other in the information exchangeable manner, the second control unit requests the first control unit to transmit the first information when receiving a first signal serving as a trigger for performing the first control with the first board and the second board connected to each other in the information exchangeable manner, the cable includes a first connector to be connected to the first board, and a second connector to be connected to the second board, the first connector and the second connector respectively include terminals from which different voltage signals are output, and the first signal corresponds to the voltage signal output from the terminal of the second connector.

DETAILED DESCRIPTION

Embodiments will be described below with reference to the attached drawings.

First Embodiment

<General Configuration>

Figure 1:
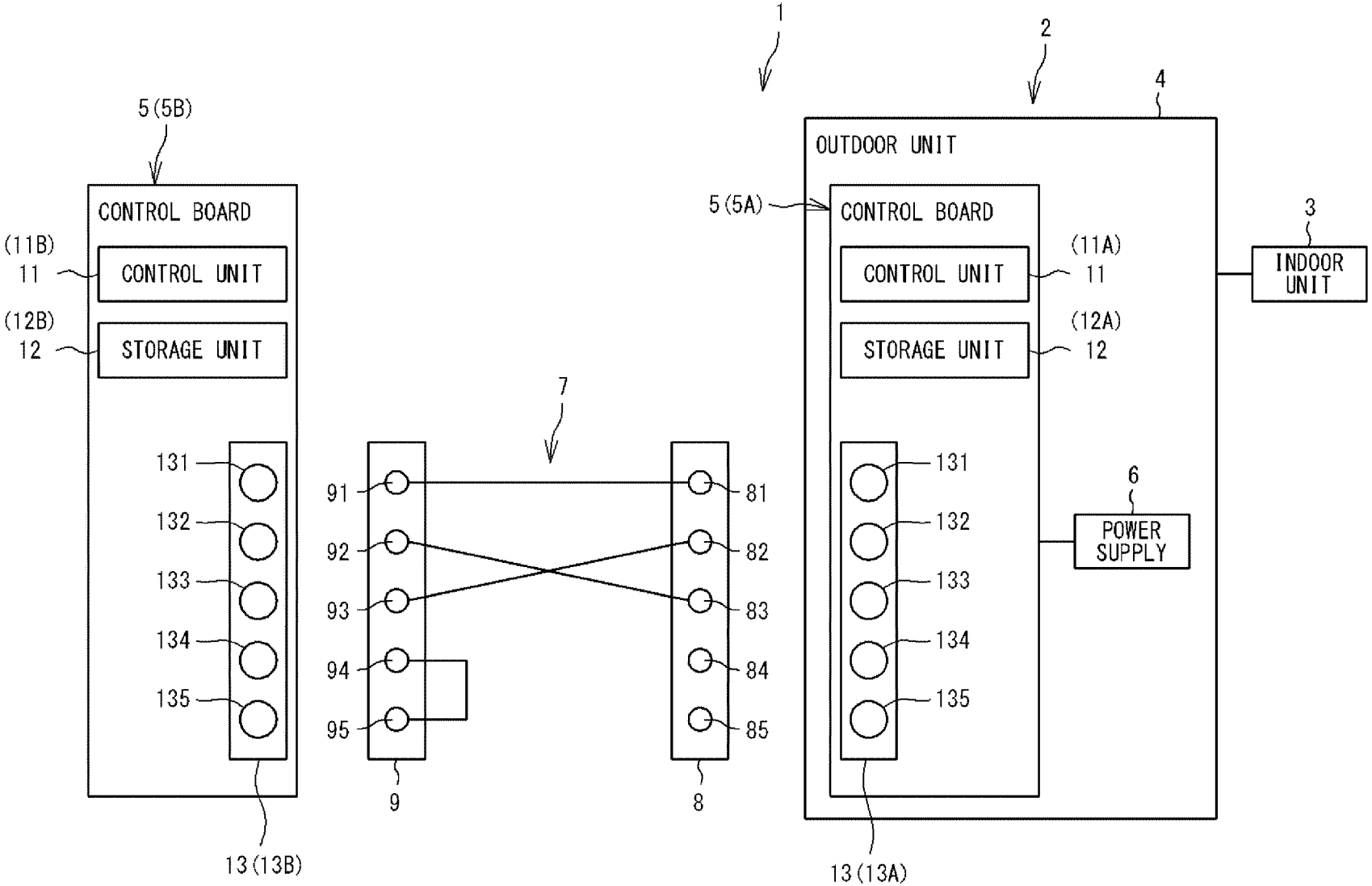
FIG. 1 is a schematic configuration diagram of an information takeover system according to a first embodiment.

FIG. 1 is a schematic configuration diagram of an information takeover system according to a first embodiment. An information takeover system 1 includes an air conditioning apparatus 2. The air conditioning apparatus 2 adjusts a temperature, a humidity, and the like in a room through a vapor compression refrigeration cycle. The air conditioning apparatus 2 mainly includes an indoor unit 3 and an outdoor unit 4.

The indoor unit 3 is installed in the room and is connected to the outdoor unit 4 with a refrigerant pipe and an electric wire. The indoor unit 3 includes, for example, a heat exchanger configured to perform heat exchange between indoor air and a refrigerant, a valve configured to control a flow of the refrigerant, a fan configured to take in the indoor air, and a control board configured to control operations of the valve, the fan, and the like.

The outdoor unit 4 is installed outside the room, and includes, for example, a compressor configured to compress the refrigerant, a heat exchanger configured to perform heat exchange between outside air and the refrigerant, a valve configured to control a flow of the refrigerant, a fan configured to take in the outside air, a control board 5 configured to control operations of the compressor, the valve, the fan, and the like, and a power supply 6. The power supply 6 is connected to an external power supply system (not illustrated). The power supply 6 is electrically connected to the components (e.g., the control board 5, the compressor, the valve, the fan) of the outdoor unit 4. The components of the outdoor unit 4 each receive electric power from the power supply 6.

<Control Board>

The control board 5 includes a control unit 11, a storage unit 12, and a connection unit 13.

The storage unit 12 is, for example, a nonvolatile memory element such as an electrically erasable programmable read only memory (EEPROM). The storage unit 12 stores first information about the air conditioning apparatus 2. The first information according to this embodiment is information about the outdoor unit 4 of the air conditioning apparatus 2.

Figure 2:
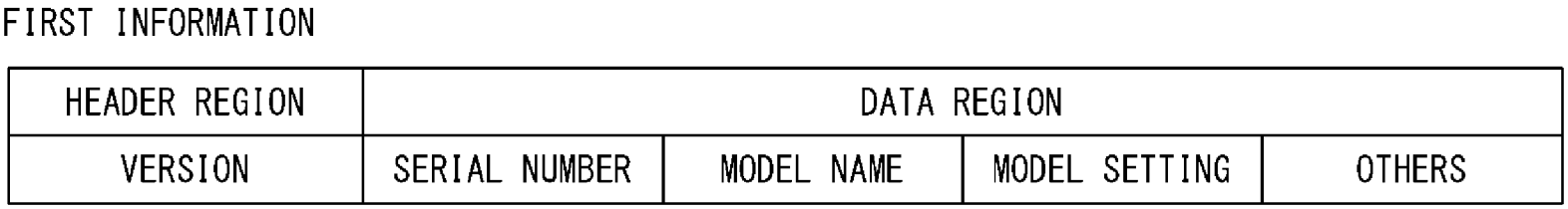
FIG. 2 is a diagram illustrating an exemplary configuration of first information.

FIG. 2 is a diagram illustrating an exemplary configuration of the first information. The first information includes a header region and a data region. The header region stores data indicating a version of the first information. The version of the first information is determined in accordance with a model and the like of the control board 5. The data region stores data indicating a serial number, a model name, a model setting, and the like of the outdoor unit 4.

Referring back to FIG. 1, the connection unit 13 is a connector to which a cable 7 (to be described later) is connected. The connection unit 13 includes a plurality of terminals (five terminals 131, 132, 133, 134, and 135 in this embodiment). The terminal 131 is a power supply terminal configured to receive electric power. The terminal 132 is a transmission terminal capable of transmitting the first information and the like. The terminal 133 is a reception terminal capable of receiving the first information and the like. The terminal 134 is an input terminal to which a first signal (to be described later) is input. The terminal 135 is a ground terminal that is grounded.

The control unit 11 is a microcomputer constituted of a central processing unit (CPU) and the like. In a case where the control board 5, on which the control unit 11 is mounted, becomes defective, and the defective control board 5 is replaced with anew control board 5, the control unit 11 is capable of performing first control to transmit the first information to the new control board 5. Details of the first control will be described later.

In a case where the control board 5, on which the control unit 11 is mounted, is the new control board 5, and the defective control board 5 is replaced with the new control board 5, the control unit 11 is capable of performing second control to receive the first information from the defective control board 5. Details of the second control will be described later.

In the following, the defective control board 5 is referred to as a first board 5A, and the new control board 5 is referred to as a second board 5B (also see FIG. 3). With regard to the first board 5A, the control unit 11, the storage unit 12, and the connection unit 13 are respectively referred to as a first control unit 11A, a first storage unit 12A, and a first connection unit 13A. With regard to the second board 5B, the control unit 11, the storage unit 12, and the connection unit 13 are respectively referred to as a second control unit 11B, a second storage unit 12B, and a second connection unit 13B.

In a state before the second board 5B is connected to the first board 5A (i.e., an initial state before shipment of the second board 5B), the second storage unit 12B stores empty first information. The term "empty" means that no data is stored in the data region of the first information, and involves a case where a version is stored in the header region of the first information. In this embodiment, the version is stored in the header region of the empty first information.

The second storage unit 12B is capable of storing the first information transmitted by the first control from the first board 5A to the second board 5B. Specifically, the second storage unit 12B is capable of copying the data in the data region of the first information transmitted by the first control from the first board 5A to the second board 5B, to the empty data region of the first information stored in the second storage unit 12B.

<Cable>

The information takeover system 1 further includes the cable 7 configured to connect the first board 5A and the second board 5B to each other in an information exchangeable manner. The cable 7 includes a first connector 8 connectable to the first connection unit 13A of the first board 5A, and a second connector 9 connectable to the second connection unit 13B of the second board 5B. The first connector 8 includes a plurality of terminals (five terminals 81, 82, 83, 84, and 85 in this embodiment). When the first connector 8 is connected to the first connection unit 13A, the terminals 81, 82, 83, 84, and 85 are respectively connected to the power supply terminal 131, transmission terminal 132, reception terminal 133, input terminal 134, and ground terminal 135 of the first connection unit 13A.

The second connector 9 includes a plurality of terminals (five terminals 91, 92, 93, 94, and 95 in this embodiment). When the second connector 9 is connected to the second connection unit 13B, the terminals 91, 92, 93, 94, and 95 are respectively connected to the power supply terminal 131, transmission terminal 132, reception terminal 133, input terminal 134, and ground terminal 135 of the second connection unit 13B.

Figure 3:
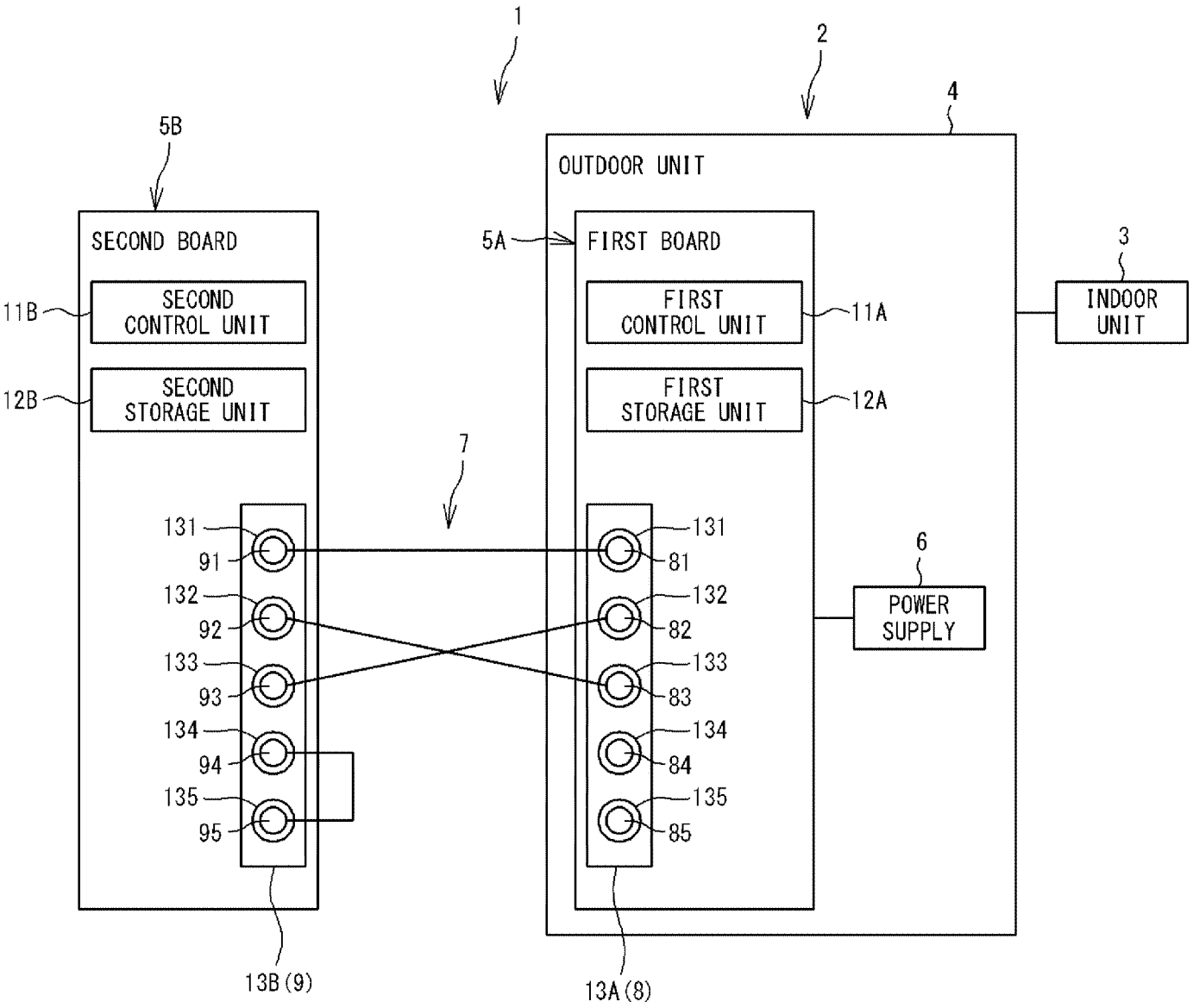
FIG. 3 is an explanatory diagram illustrating a state in which a first board and a second board are connected to each other with a cable.

FIG. 3 is an explanatory diagram illustrating a state in which the first board 5A and the second board 5B are connected to each other with the cable 7. In this embodiment, the second board 5B is connected with the cable 7 to the first board 5A that remains mounted to the outdoor unit 4. In this connection state, the power supply terminal 131 of the first connection unit 13A is electrically connected to the power supply 6, so that the first board 5A receives electric power from the power supply 6.

The first connector 8 and the second connector 9 of the cable 7 are respectively connected to the first connection unit 13A of the first board 5A and the second connection unit 13B of the second board 5B. The terminal 81 of the first connector 8 and the terminal 91 of the second connector 9 are electrically connected to each other. The power supply terminal 131 of the second connection unit 13B is electrically connected to the power supply terminal 131 of the first connection unit 13A via the terminals 81 and 91 of the cable 7. With this connection, the second board 5B receives electric power from the first board 5A through the cable 7.

In the second connector 9 of the cable 7, the terminal 94 and the terminal 95 are electrically connected to each other. When the second connector 9 is connected to the second connection unit 13B, the input terminal 134 of the second connection unit 13B is electrically connected to the ground terminal 135 of the second connection unit 13B via the terminals 94 and 95 of the second connector 9. Accordingly, when the second connector 9 is connected to the second connection unit 13B, a low-voltage LOW signal (a voltage signal) is automatically output from the terminal 94 of the second connector 9 to the input terminal 134 of the second connection unit 13B.

In the first connector 8 of the cable 7, the terminal 84 and the terminal 85 are not electrically connected to each other. Therefore, even when the first connector 8 is connected to the first connection unit 13A, the input terminal 134 of the first connection unit 13A is not electrically connected to the ground terminal 135 of the first connection unit 13A. Accordingly, when the first connector 8 is connected to the first connection unit 13A, a high-voltage HIGH signal (a voltage signal) is automatically output from the terminal 84 of the first connector 8 to the input terminal 134 of the first connection unit 13A.

As described above, the first connector 8 and the second connector 9 respectively include the terminal 84 and the terminal 94 from which different signals (e.g., the HIGH signal, the LOW signal) are output. The LOW signal output from the terminal 94 of the second connector 9 is used as a first signal serving as a trigger when the first control unit 11A performs the first control.

In the cable 7, the terminal 82 of the first connector 8 is electrically connected to the terminal 93 of the second connector 9. When the first connector 8 and the second connector 9 are respectively connected to the first connection unit 13A and the second connection unit 13B, the transmission terminal 132 of the first connection unit 13A is electrically connected to the reception terminal 133 of the second connection unit 13B via the terminals 82 and 93 of the cable 7. Information can thus be transmitted from the first board 5A to the second board 5B through the cable 7.

In the cable 7, the terminal 92 of the second connector 9 is electrically connected to the terminal 83 of the first connector 8. When the first connector 8 and the second connector 9 are respectively connected to the first connection unit 13A and the second connection unit 13B, the transmission terminal 132 of the second connection unit 13B is electrically connected to the reception terminal 133 of the first connection unit 13A via the terminals 92 and 83 of the cable 7. Information can thus be transmitted from the second board 5B to the first board 5A through the cable 7.

<Control Example of Information Takeover System>

Figure 4:
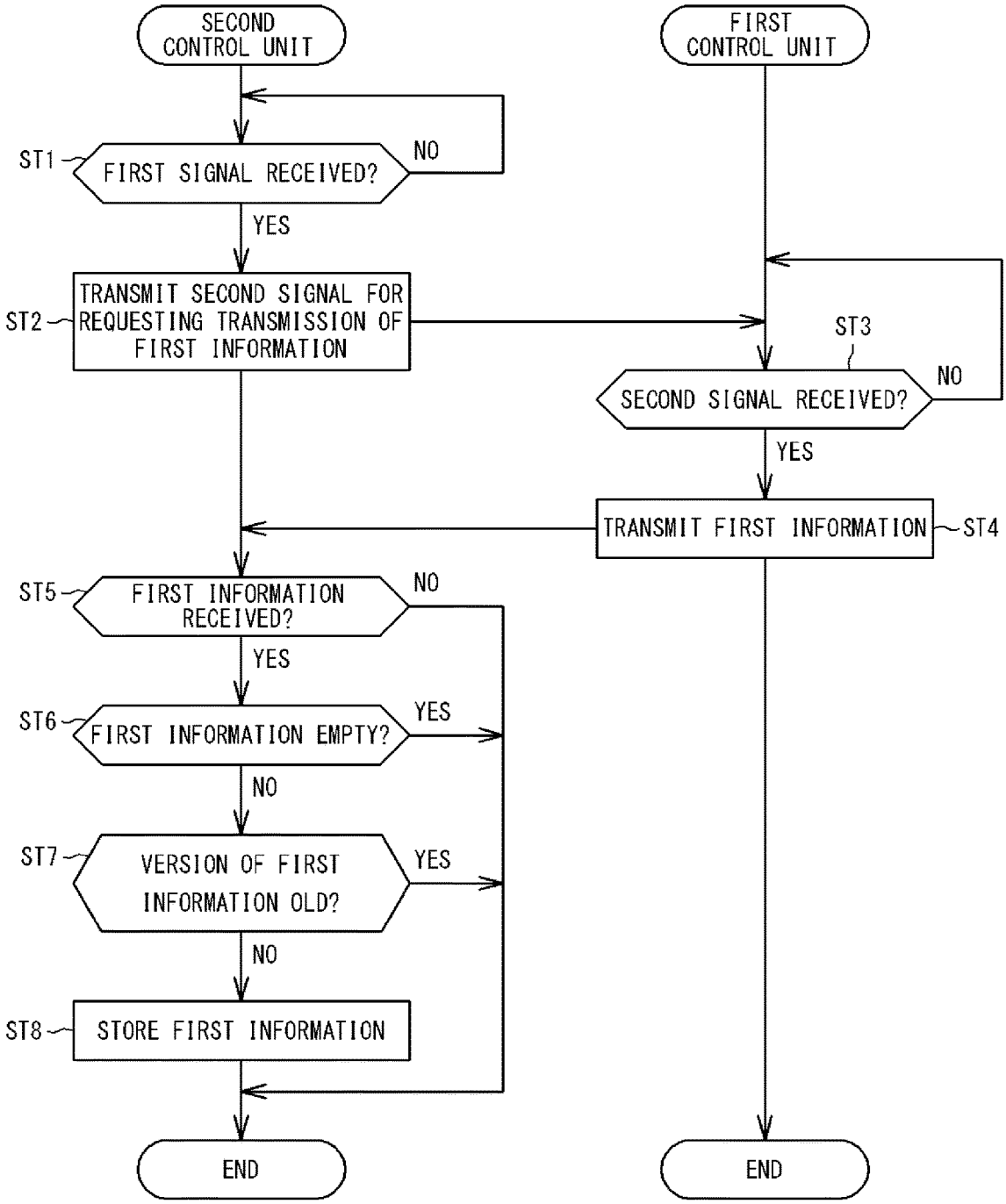
FIG. 4 is a sequence diagram illustrating exemplary control performed by a first control unit of the first board and exemplary control performed by a second control unit of the second board.

FIG. 4 is a sequence diagram illustrating exemplary control performed by the first control unit 11A of the first board 5A and exemplary control performed by the second control unit 11B of the second board 5B. When the first board 5A and the second board 5B are connected to each other in the information exchangeable manner with the cable 7 (see FIG. 3), the first signal (the LOW signal) is input to the second connection unit 13B of the second board 5B as described above.

The second control unit 11B determines whether the first signal has been received through the second connection unit 13B (step ST1). The second control unit 11B, when not receiving the first signal ("No" in step ST1), makes a determination in step ST1 again after a lapse of a predetermined time.

The second control unit 11B, when receiving the first signal ("Yes" in step ST1), performs the second control to receive the first information from the first board 5A. Specifically, the second control unit 11B performs the second control to transmit, to the first control unit 11A, a second signal for requesting the first control unit 11A to transmit the first information (step ST2). The second signal is transmitted from the transmission terminal 132 of the second connection unit 13B, and then is received at the reception terminal 133 of the first connection unit 13A through the terminals 92 and 83 of the cable 7.

The first control unit 11A determines whether the second signal has been received through the first connection unit 13A (step ST3). The first control unit 11A, when not receiving the second signal ("No" in step ST3), makes a determination in step ST3 again after a lapse of a predetermined time.

The first control unit 11A, when receiving the second signal ("Yes" in step ST3), performs the first control to transmit the first information to the second board 5B. Specifically, the first control unit 11A transmits the first information stored in the first storage unit 12A, to the second control unit 11B (step ST4). The first information is transmitted from the transmission terminal 132 of the first connection unit 13A, and then is received at the reception terminal 133 of the second connection unit 13B via the terminals 82 and 93 of the cable 7.

The second control unit 11B determines whether the first information has been received through the second connection unit 13B (step ST5). The second control unit 11B, when not receiving the first information ("No" in step ST5), terminates the processing.

The second control unit 11B, when receiving the first information ("Yes" in step ST5), determines whether the received first information is empty (step ST6). Specifically, the second control unit 11B determines whether the data capacity in the data region of the received first information is zero. The second control unit 11B, when determining that the received first information is empty ("Yes" in step ST6), terminates the processing without storing the first information in the second storage unit 12B.

The second control unit 11B, when determining that the received first information is not empty ("No" in step ST6), determines whether to store the received first information in the second storage unit 12B, based on the version of the first information. Specifically, the second control unit 11B determines whether the version of the received first information is older than a predetermined version (step ST7). It should be noted that the determination in step ST7 is not limited to that described in this embodiment. For example, the second control unit 11B may determine whether the version of the received first information is older than the version of the first information in the second board 5B.

The second control unit 11B, when determining that the version of the received first information is older than the predetermined version ("Yes" in step ST7), terminates the processing without storing the first information in the second storage unit 12B.

The second control unit 11B, when determining that the version of the received first information is not older than the predetermined version ("No" in step ST7), stores the first information in the second storage unit 12B (step ST8). Specifically, the second control unit 11B copies the data in the data region of the received first information to the empty data region of the first information stored in the second storage unit 12B.

Figure 5:
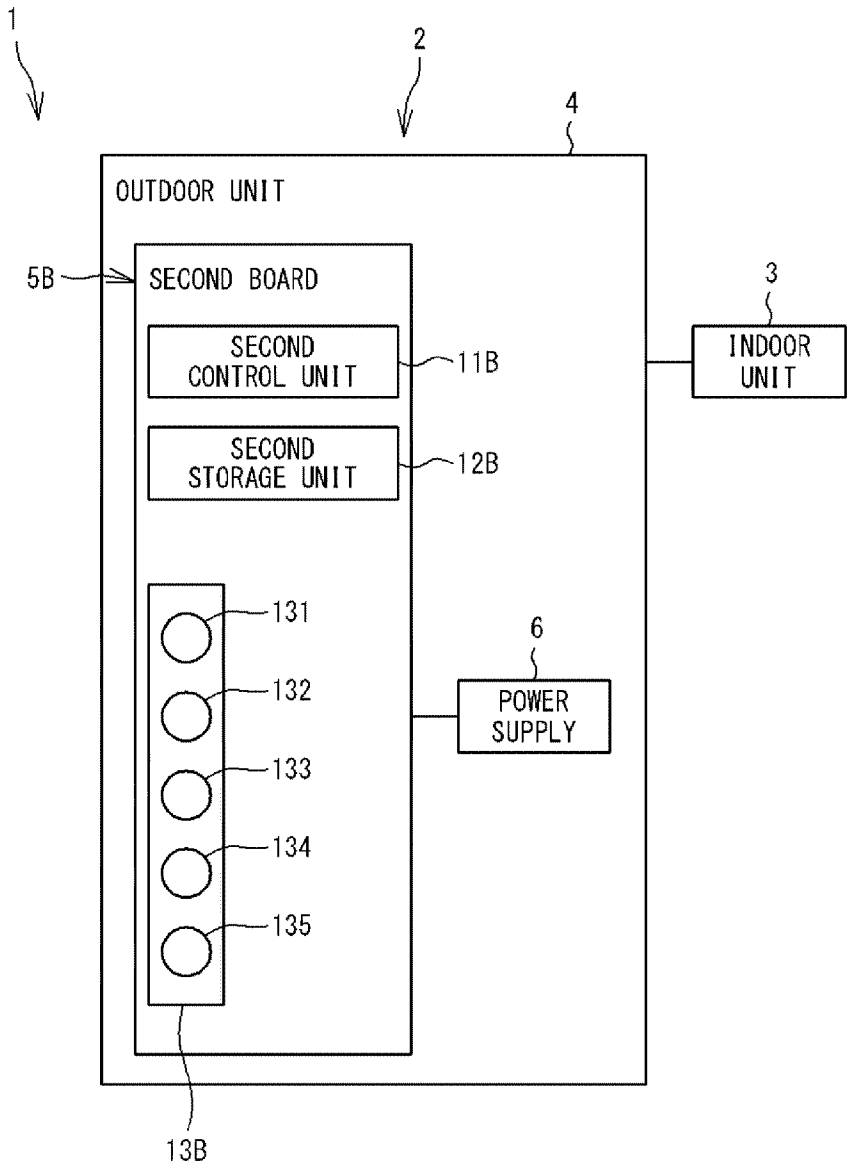
FIG. 5 is a schematic configuration diagram of an outdoor unit and illustrates a state after replacement of the first board with the second board.

Takeover of the first information can thus be performed from the first board 5A to the second board 5B. After completion of the takeover of the first information to the second board 5B, the first connector 8 and the second connector 9 of the cable 7 in the state illustrated in FIG. 3 are respectively disconnected from the first connection unit 13A and the second connection unit 13B. Thereafter, the first board 5A is removed from the outdoor unit 4, and then the second board 5B is mounted to the outdoor unit 4 as illustrated in FIG. 5. Replacement of the first board 5A with the second board 5B is thus completed.

<Modifications>

In replacing the first board 5A with the second board 5B, the first board 5A may be removed from the outdoor unit 4 and the second board 5B may be mounted to the outdoor unit 4 as illustrated in FIG. 5, prior to the takeover of the first information from the first board 5A to the second board 5B.

The second board 5B mounted to the outdoor unit 4 receives electric power from the power supply 6.

Figure 6:
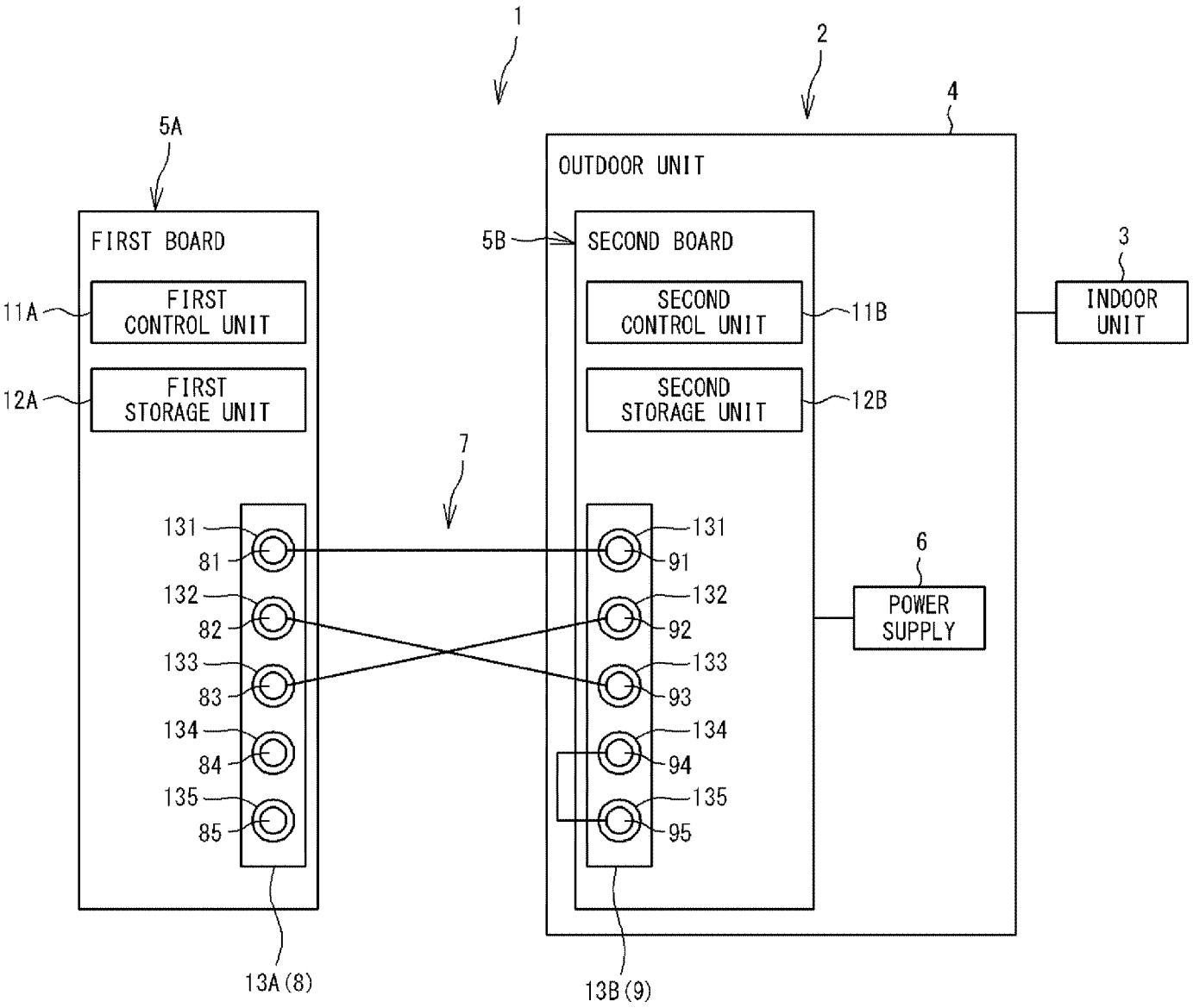
FIG. 6 is an explanatory diagram illustrating a modification of the first embodiment.

Thereafter, as illustrated in FIG. 6, the first connector 8 of the cable 7 is connected to the first connection unit 13A of the removed first board 5A. The second connector 9 of the cable 7 is connected to the second connection unit 13B of the second board 5B mounted to the outdoor unit 4. In this connection state, the first board 5A is capable of receiving electric power from the second board 5B through the cable 7. In addition, since the first signal is input to the second connection unit 13B through the cable 7, the first control unit 11A and the second control unit 11B execute processing (step ST1 to step ST8) similar to that described in the foregoing embodiment.

Takeover of the first information can thus be performed from the first board 5A to the second board 5B. After completion of the takeover of the first information to the second board 5B, the first connector 8 and the second connector 9 of the cable 7 are respectively disconnected from the first connection unit 13A and the second connection unit 13B. Replacement of the first board 5A with the second board 5B is thus completed.

According to the air conditioning apparatus disclosed in Patent Literature 1, it is necessary to back up the information stored in the memory of the defective control board and to transfer the backed up information to the memory of the new control board, with a personal computer or the like connected to the air conditioning apparatus. This results in a problem that the backup and transfer of the information stored in the memory take time and effort.

An object of the present disclosure is to take over information about an air conditioning apparatus with ease.

<Functional Effects>

In the information takeover system 1 according to this embodiment, the first control unit 11A performs the first control with the first board 5A and the second board 5B connected to each other with the cable 7, thereby transmitting the first information stored in the first storage unit 12A, to the second board 5B. This configuration facilitates takeover of the first information about the outdoor unit 4 from the first board 5A to the second board 5B.

The second control unit 11B of the second board 5B requests the first control unit 11A to transmit the first information when receiving the first signal serving as a trigger for performing the first control with the first board 5A and the second board 5B connected to each other in the information exchangeable manner. The first control unit 11A is capable of automatically performing the first control, based on this request. In addition, the first control unit 11A performs the first control as described above to facilitate transmission of the first information from the first board 5A to the second board 5B.

The first connector 8 and the second connector 9 of the cable 7 respectively include the terminal 84 and the terminal 94 from which different signals (e.g., the HIGH signal, the LOW signal) are output. This configuration allows the second control unit 11B to automatically receive the first signal (the LOW signal) in such a manner that the first board 5A and the second board 5B are connected to each other with the cable 7.

The second control unit 11B does not store the first information received from the first board 5A in the second storage unit 12B when the version of the received first information is older than the predetermined version. This configuration suppresses the occurrence of malfunction owing to a difference in version.

The second control unit 11B does not store the first information received from the first board 5A in the second storage unit 12B when the received first information is empty. This configuration suppresses a possibility that the empty first information is stored in the second storage unit 12B of the second board 5B.

The second board 5B (or the first board 5A) receives electric power from the first board 5A (or the second board 5B) through the cable 7 with the first board 5A (or the second board 5B) electrically connected to the power supply 6 of the outdoor unit 4. According to this configuration, there is no necessity to prepare a dedicated power supply for supplying electric power to the second board 5B (or the first board 5A). This configuration therefore further facilitates takeover of the first information from the first board 5A to the second board 5B.

Second Embodiment

Figure 7:
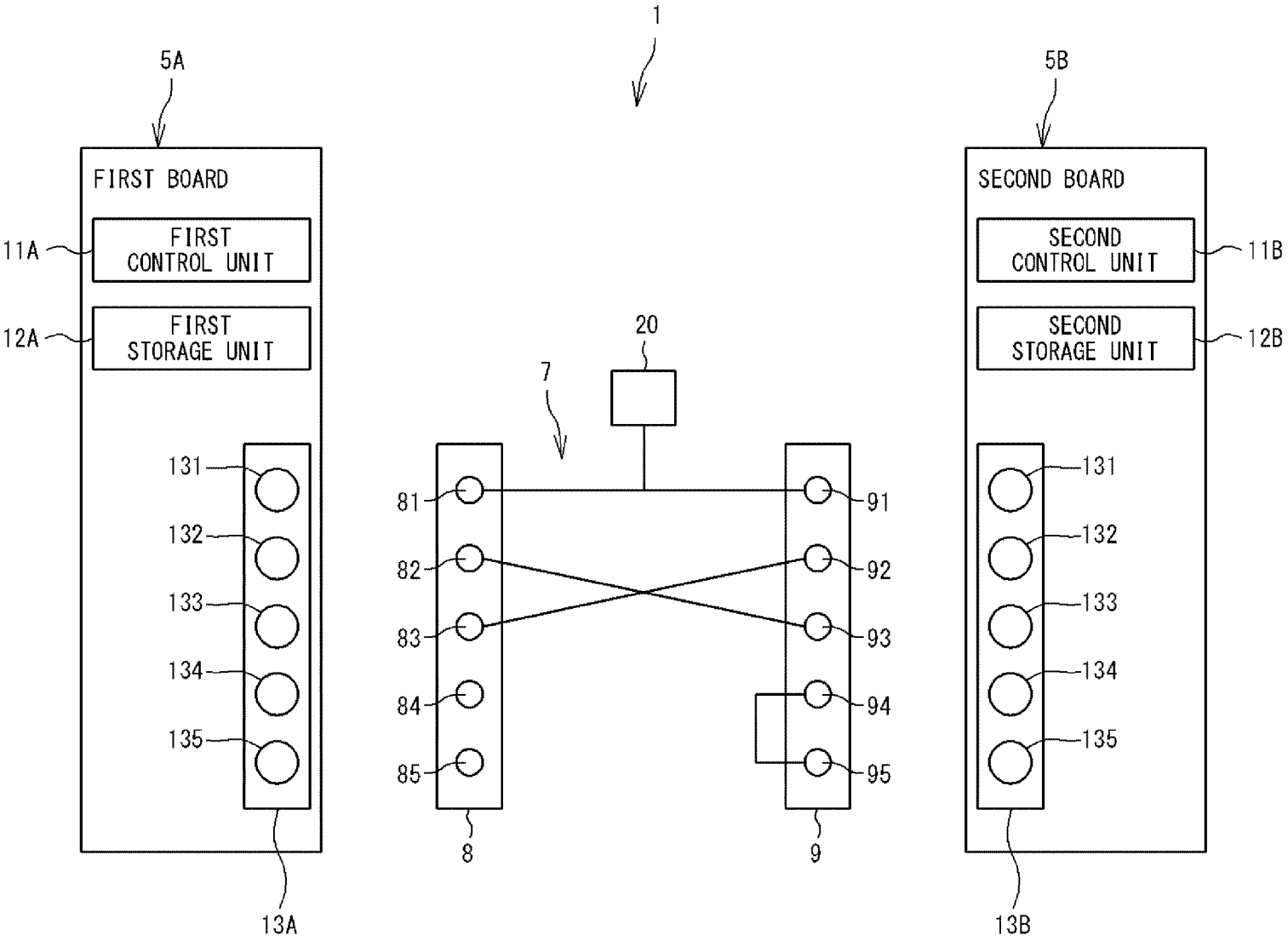
FIG. 7 is a schematic configuration diagram of an information takeover system according to a second embodiment.

FIG. 7 is a schematic configuration diagram of an information takeover system 1 according to a second embodiment. In this embodiment, a cable 7 is equipped with a battery 20. The battery 20 is configured to supply electric power to a first board 5A and a second board 5B with the first board 5A and the second board 5B connected to each other with the cable 7. The battery 20 is connected to a terminal 81 of a first connector 8 of the cable 7 and a terminal 91 of a second connector 9 of the cable 7.

Figure 8:
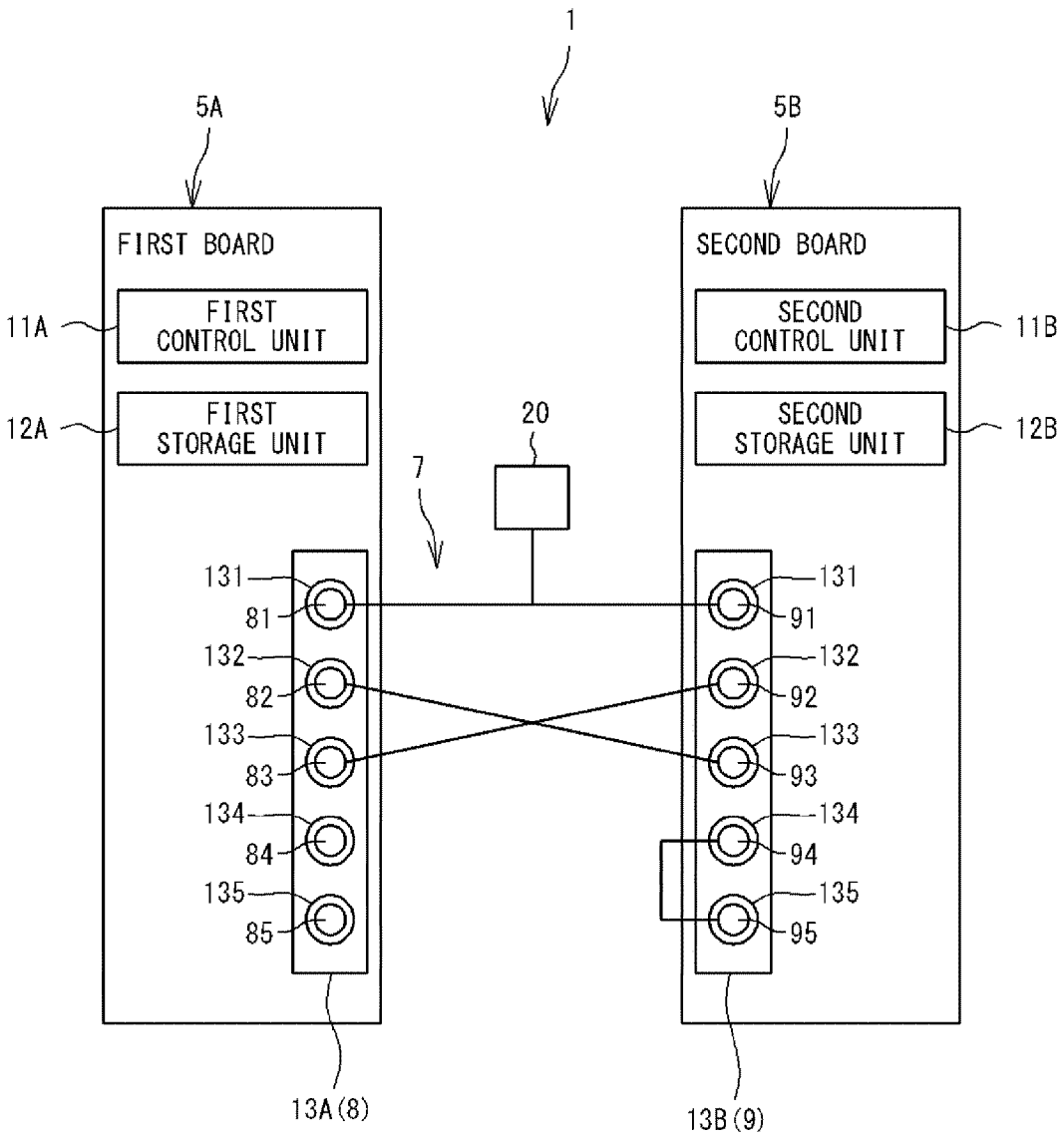
FIG. 8 is an explanatory diagram illustrating a state in which a first board and a second board are connected to each other with a cable in the second embodiment.

FIG. 8 is an explanatory diagram illustrating a state in which the first board 5A and the second board 5B are connected to each other with the cable 7. As illustrated in FIG. 8, in this embodiment, the first board 5A and the second board 5B are connected to each other with the cable 7 in a state in which neither the first board 5A nor the second board 5B is mounted to an outdoor unit 4. In this connection state, the terminal 81 of the first connector 8, which is connected to the battery 20, is connected to a power supply terminal 131 of a first connection unit 13A. The terminal 91 of the second connector 9, which is connected to the battery 20, is connected to a power supply terminal 131 of a second connection unit 13B.

Each of the first board 5A and the second board 5B is thus capable of receiving electric power from the battery 20 through the cable 7. In addition, since a first signal is input to the second connection unit 13B through the cable 7, the first control unit 11A and the second control unit 11B execute processing (step ST1 to step ST8) similar to that described in the foregoing embodiment. Other configurations of this embodiment are similar to those of the first embodiment. Therefore, these configurations are denoted with reference signs identical with those of the similar configurations, and the detailed description thereof will not be given here.

Also in the information takeover system 1 according to the second embodiment, the first control unit 11A performs first control with the first board 5A and the second board 5B connected to each other with the cable 7, thereby transmitting first information stored in a first storage unit 12A, to the second board 5B. This configuration facilitates takeover of the first information about the outdoor unit 4 from the first board 5A to the second board 5B.

This configuration also enables supply of electric power from the battery 20 on the cable 7 to each of the first board 5A and the second board 5B in such a manner that the first board 5A and the second board 5B are connected to each other with the cable 7. This configuration enables takeover of the first information from the first board 5A to the second board 5B even at a place distant from the outdoor unit 4.

[Others]

The information takeover system according to each of the foregoing embodiments is designed to take over the first information about the outdoor unit 4, but may be applied to a case of taking over first information about another component (e.g., the indoor unit 3) of the air conditioning apparatus 2.

In each of the foregoing embodiments, the second control unit 11B receives the first signal serving as a trigger for performing the first control. The first control unit 11A may alternatively receive the first signal. In this case, the first control unit 11A is preferably configured to perform, when receiving the first signal, first control to transmit the first information to the second board 5B.

The first control is performed based on reception of the first signal through the cable 7; however, the first control is not necessarily performed based on the reception of the first signal. For example, the second control unit 11B may determine whether the first information stored in the second storage unit 12B is empty, and may request the first control unit 11A to perform the first control when the first information is empty.

The present disclosure is not limited to the foregoing exemplary description, and all changes that fall within metes and bounds of the claims, or equivalence such metes and bounds thereof are therefore intended to be embraced by the claims.

REFERENCE SIGNS LIST

1 information takeover system
2 air conditioning apparatus
3 indoor unit
4 outdoor unit
5A first board
5B second board
6 power supply
7 cable
8 first connector
9 second connector
11A first control unit
11B second control unit
12A first storage unit
12B second storage unit
13 connection unit
20 battery
84, 94 terminal
134 terminal

The invention claimed is:

1. An information takeover system comprising:

a first board that includes a first control unit, and a first storage unit storing first information about an air conditioning apparatus; and a second board that includes a second control unit and is connectable to the first board in an information exchangeable manner; and a cable configured to connect the first board and the second board to each other in the information exchangeable manner, wherein the first control unit is configured to perform first control to transmit the first information to the second board with the first board and the second board connected to each other in the information exchangeable manner, the second control unit requests the first control unit to transmit the first information when receiving a first signal serving as a trigger for performing the first control with the first board and the second board connected to each other in the information exchangeable manner, the cable includes a first connector to be connected to the first board, and a second connector to be connected to the second board, the first connector and the second connector respectively include terminals from which different voltage signals are output, and the first signal corresponds to the voltage signal output from the terminal of the second connector.

2. The information takeover system according to claim 1, wherein the second board further includes a second storage unit in which the first information is storable, and the second control unit determines whether to store, in the second storage unit, the first information received by the first control from the first board, based on a version of the first information.

3. The information takeover system according to claim 2, wherein the second board further includes a second storage unit in which the first information is storable, and the second control unit does not store, in the second storage unit, the first information received by the first control from the first board on condition that the first information is empty.

4. The information takeover system according to claim 2, wherein one of the first board and the second board is electrically connected to a power supply of the air conditioning apparatus, and a remaining one of the first board and the second board receives electric power from the one of the first board and the second board.

5. The information takeover system according to claim 1, wherein the second board further includes a second storage unit in which the first information is storable, and the second control unit does not store, in the second storage unit, the first information received by the first control from the first board on condition that the first information is empty.

6. The information takeover system according to claim 5, wherein one of the first board and the second board is electrically connected to a power supply of the air conditioning apparatus, and a remaining one of the first board and the second board receives electric power from the one of the first board and the second board.

7. The information takeover system according to claim 1, wherein one of the first board and the second board is electrically connected to a power supply of the air conditioning apparatus, and a remaining one of the first board and the second board receives electric power from the one of the first board and the second board.

8. The information takeover system according to claim 1, wherein the first control enables the first information to transmit from the first board directly to the second board, thereby enhancing efficiency of the first control by eliminating a requirement for additional resources to transmit the first information from the first board to the second board.

9. An information takeover system comprising:

a first board that includes a first control unit, and a first storage unit storing first information about an air conditioning apparatus;

a second board that includes a second control unit and is connectable to the first board in an information exchangeable manner; and a cable configured to connect the first board and the second board to each other in the information exchangeable manner, wherein the cable is equipped with a battery, and the first control unit is configured to perform first control to transmit the first information to the second board with the first board and the second board connected to each other in the information exchangeable manner.

10. The information takeover system according to claim 9, wherein the first control enables the first information to transmit from the first board directly to the second board, thereby enhancing efficiency of the first control by eliminating a requirement for additional resources to transmit the first information from the first board to the second board.

11. An information takeover method for taking over first information about an air conditioning apparatus, the first information being stored in a first storage unit of a first board, from the first board to a second board, the information takeover method comprising:

a step of connecting a first connector of a cable to the first board and connecting a second connector of the cable to the second board to connect, with the cable, the first board and the second board to each other in an information exchangeable manner, a step of receiving, by a second control unit of the second board, a voltage signal, as a first signal, output from the second connector and different from a voltage signal output from the first connector with the first board and the second board connected to each other in the information exchangeable manner;

a step of requesting, by the second control unit that has received the first signal, a first control unit of the first board to transmit the first information; and a step of performing, by the first control unit, first control to transmit the first information to the second board, in response to a request for transmission of the first information.

12. The information takeover method of claim 11, wherein the step of performing the first control enables the first information to transmit from the first board directly to the second board, thereby enhancing efficiency of the first control by eliminating a requirement for additional resources to transmit the first information from the first board to the second board.

13. An information takeover method for taking over first information about an air conditioning apparatus, the first information being stored in a first storage unit of a first board, from the first board to a second board, the information takeover method comprising:

a step of connecting, with a cable equipped with a battery, the first board and the second board to each other in an information exchangeable manner, a step of requesting, by a second control unit of the second board, a first control unit of the first board to transmit the first information with the first board and the second board connected to each other in the information exchangeable manner; and a step of performing, by the first control unit, first control to transmit the first information to the second board, in response to a request for transmission of the first information.

14. The information takeover method of claim 13, wherein the step of performing the first control enables the first information to transmit from the first board directly to the second board, thereby enhancing efficiency of the first control by eliminating a requirement for additional resources to transmit the first information from the first board to the second board.

* * * * *